United States Patent [19]

Tomoyoshi

[11] 4,092,624

[45] May 30, 1978

[54] THERMOSTAT ASSEMBLY

[75] Inventor: Uchiya Tomoyoshi, Misato, Japan

[73] Assignee: Uchiya Co., Ltd., Japan

[21] Appl. No.: 714,399

[22] Filed: Aug. 16, 1976

[30] Foreign Application Priority Data

| | | |
|---|---|---|
| Aug. 15, 1975 | Japan | 50-112947[U] |
| Aug. 15, 1975 | Japan | 50-112948[U] |
| Aug. 15, 1975 | Japan | 50-112949[U] |

[51] Int. Cl.[2] ..... H01H 37/52

[52] U.S. Cl. ..... 337/340; 337/371; 337/378

[58] Field of Search ..... 337/42, 39–41, 337/86, 96, 299, 337, 338, 340, 342, 363, 370, 371, 378

[56] References Cited

U.S. PATENT DOCUMENTS

| | | | |
|---|---|---|---|
| 2,101,637 | 12/1937 | Davis | 337/370 |
| 2,925,483 | 2/1960 | Wells | 337/364 |
| 3,047,771 | 7/1962 | Clark | 337/364 X |
| 3,171,933 | 3/1965 | Webb et al. | 337/370 X |

*Primary Examiner*—George Harris

*Attorney, Agent, or Firm*—George B. Oujevolk

[57] ABSTRACT

A thermostat assembly which includes therein two sets of thermostats connected in series with each other.

4 Claims, 9 Drawing Figures

THERMOSTAT ASSEMBLY

This invention relates to a thermostat assembly which includes therein two sets of thermostats connected in series with each other.

As protectors for preventing the buring of electric equipments or appliances (for example, motors, transformers and solenoids), there are arrangements belonging to the overcurrent sensing system (for example, circuit breakers and current fuses) which operate to open a circuit by sensing an abnormal overcurrent at the short-circuit or dielectric breakdown of the circuit, and arrangements belonging to the heat sensing system (for example, thermostats and temperature fuses) which operate to open a circuit by sensing an abnormal temperature rise developing at the overload or rotor lock of the motor.

In some cases the protector has damage to its contacts due to the repetition of the "on"-"off" operations during use, and the in other cases the contacts have fusion trouble. In order to prevent such trouble, it has heretofore been the common practice to prepare two sets of protectors belonging to the overcurrent sensing system or the heat sensing system and to package them in series connection in the electric equipment of the appliance.

In some cases one set of protector belonging to the overcurrent sensing system and one set of protector belonging to the heat sensing system are connected in series with each other and packaged in the electric equipment or appliance so as to protect the appliance from both overcurrent and overheating.

However, where the two sets of protectors individually constructed are used in combination as described, a large space for the packaging is naturally required. This is disadvantageous in such case where the protector assembly is to be packaged in a miniature equipment or appliance. Besides, the cost of the protector assembly becomes great.

An object of this invention is to provide a small-sized and low-cost thermostat assembly which includes therein two sets of thermostats electrically connected in series.

Another object of this invention is to provide a thermostat assembly of high safety which includes therein two sets of thermostats differing in the operating time or the operating temperature from each other and which effects two stages of protective operations.

Still another object of this invention is to provide a thermostat assembly which includes therein two sets of thermostats differing in the operating mechanism from each other.

The foregoing objects and advantages of this invention and other objects and advantages thereof will be more clearly understood from the following detailed description of embodiments illustrated in the accompanying drawings, in which:

FIG. 2 is a vertical sectional view taken along line A — A in FIG. 1;

Figure 7:
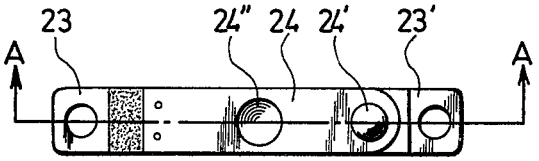
Figure 8:
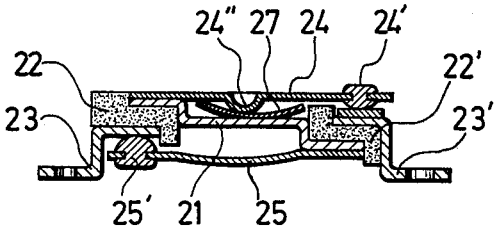
Figure 9:
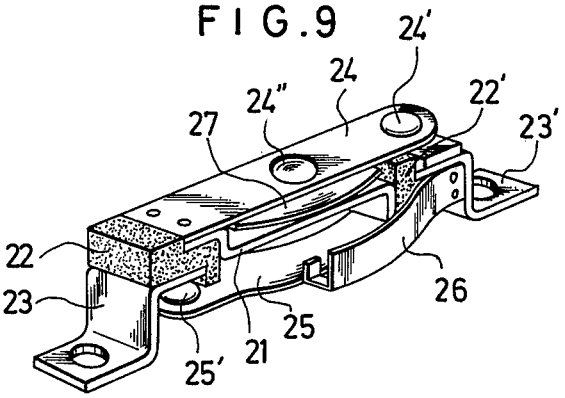

FIGS. 7 and 8 show an embodiment of a thermostat assembly according to this invention which includes therein two sets of thermostats consisting of an overcurrent sensing type thermostat and a heat sensing type thermostat, FIG. 7 being a plan view of the embodiment and FIG. 8 being a vertical sectional view taken along line A — A in FIG. 7; and FIG. 9 is a perspective view showing another embodiment of the thermostat assembly illustrated in FIGS. 7 and 8.

Figure 1:
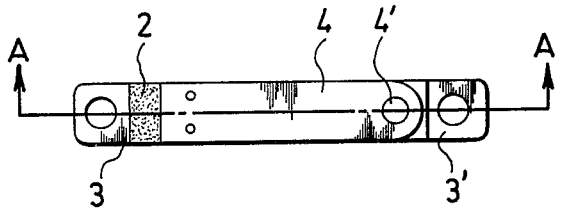
FIGS. 1 and 2 show an embodiment of a thermostat assembly according to this invention which includes therein two sets of overcurrent sensing type thermostats differing in operating time from each other, FIG. 1 being a plan view of the embodiment
Figure 2:
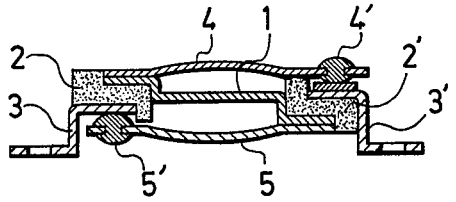

Referring to FIGS. 1 and 2, numeral 1 designates a metallic frame which is formed into steps, numerals 2 and 2' designate insulating members which are respectively joined and fixed to left and right end parts of the frame 1, and numerals 3 and 3' designate terminal fittings which are respectively fixed to the insulating members 2 and 2'. Numerals 4 and 5 denote contact arms of equal lengths which are respectively provided at upper and lower parts of the frame 1 in a manner to oppose each other. The contact arm 4 has its base part joined and fixed to the upper surface of the left end part of the frame 1, and has a contact 4' at its fore end part held abutting on the upper surface of the terminal fixture 3'. On the other hand, the contact arm 5 has its base part joined and fixed to the lower surface of the right end part of the frame 1 so as to extend in a direction differing by 180° with respect to the arm 4, and it has a contact 5' at its fore end part held abutting on the lower surface of the terminal fixture 3. The contact arms 4 and 5 mounted as described above are formed of overcurrent sensing type bimetals whose operating characteristics are respectively different. Accordingly, where overcurrents of an identical value are caused to flow through both the arms 4 and 5, the respective arms 4 and 5 have different operating times. In this embodiment, the operating time $T_1$ of the arm 4 and the operating time $T_2$ of the arm 5 are so set as to be $T_1 < T_2$.

As stated above, the thermostat assembly according to the present invention as given by this embodiment comprises two sets of thermostats, one consisting of the contact arm 4 and the terminal fixture 3' and the other consisting of the contact arm 5 and the terminal fixture 3. It has the construction in which the thermostats are integrally connected in electrical series by the frame 1. When both the thermostats are inoperative, a closed circuit is formed between both the terminal fittings 3 and 3'.

The thermostat assembly having such construction is set, as previously stated, at $T_1 < T_2$ in the relation of the respective operating times of the contact arms 4 and 5 composed of bimetals which respond to overcurrents, so that the speed of response to the overcurrent is higher at arm 4. Accordingly, where the period of time during which the overcurrents flow is comparatively short, only the contact arm 4 operates reversely to bring the circuit between the terminal fixtures 3 and 3' into the open state. In such case where, by chance, the contact 4' fuses and bonds to the terminal fixture 3' during the operation of arm 4 and the reverse operation becomes impossible, the abnormal current continually flows through the other contact arm 5 and the arm 5 operates reversely this time. That is, the thermostat assembly effects two stages of protective operations and has a safety corresponding to two conventional circuit breakers.

Figure 3:
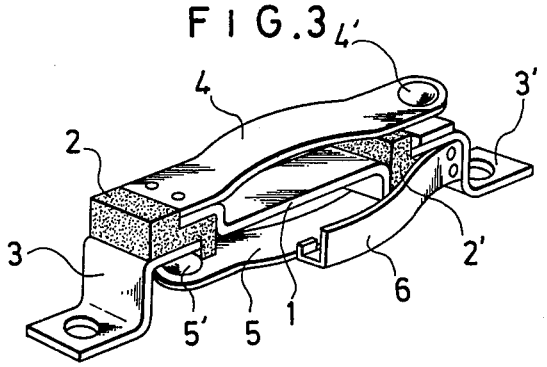
FIG. 3 is a perspective view showing another embodiment of the thermostat assembly illustrated in FIGS. 1 and 2.

In order to endow the thermostat assembly with a higher degree of protective function, it is preferable to provide a mechanism which continually holds the reverse state of contact arm 5. FIG. 3 shows an example of a thermostat assembly provided with the holding mechanism. In FIG. 3, numeral 6 designates a reset arm which is made of an elastic metal plate. A base part of the arm 6 is suitably fixed to a side part of the frame 1 or the insulating member 2', and a fore end part thereof is caused to abut against a side part of the contact arm 5 under suitable pressure. When, under this state, the contact arm 5 operates reversely and descends, the fore end of the reset arm 6 enters into the upper surface of the contact arm 5 and abuts against the surface. Accordingly, even when the contact arm 5 self-resets to the steady state, its contact 5' holds the open state continually. Thus, the equipment or appliance to which the thermostat assembly is connected stops operation perfectly.

After taking away a cause for the abnormal current from the equipment or appliance, the fore end of the reset arm 6 is moved from the upper surface of the contact arm 5 back to the original position by the use of pincettes or the like. By thus returning the arm 5 to the closed circuit state, the thermostat assembly can prepare for the succeeding protective operation again.

The thermostat assembly of this embodiment has a function corresponding to two circuit breakers. Moreover, it is structurally simple and can be constructed compactly and at low cost. Therefore, it is suitable as a safety device for an equipment or appliance limited in space and in cost, especially for a miniature motor, a miniature transformer or a miniature solenoid.

Description will now be made of a thermostat assembly according to the present invention which employs as a thermal sensor a heat sensing type bimetal which operates by sensing an excessive rise in the ambient temperature.

Figure 4:
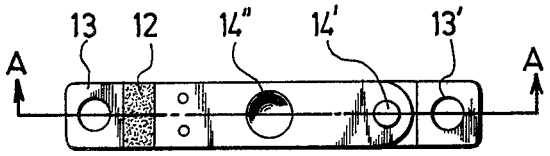
FIGS. 4 and 5 show an embodiment of a thermostat assembly according to this invention which includes therein two sets of heat sensing type thermostats differing in operating temperature from each other, FIG. 4 being a plan view of the embodiment and FIG. 5 being a vertical sectional view taken along line A — A in FIG. 4.
Figure 5:
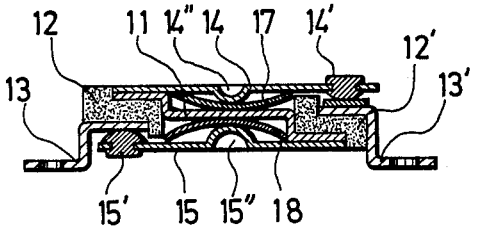

As illustrated in FIGS. 4 and 5, the thermostat assembly comprises a metallic frame 11, insulating members 12 and 12' and terminal fittings 13 and 13', these constituents being similar to those of the thermostat assembly shown in FIGS. 1 and 2. Contact arms 14 and 15 are joined to and supported on the frame 11 in directions at 180° to each other. Both the contact arms 14 and 15 are formed of elastic metal plates, they are respectively provided with contacts 14' and 15' at end parts, and they are respectively provided at central parts with semicircular protrusions 14'' and 15'' which protrudes towards the frame 11. Numerals 17 and 18 designate arcuate bimetals which are interposed between the frame 11 and the arm 14 and between the frame 11 and the arm 15, respectively. The bimetals 17 and 18 have operating temperatures different from each other. Letting $t_1°$ denote the operating temperature of the bimetal 17 and $t_2°$ denote that of the bimetal 18, the relation of the operating characteristics of both the bimetals is so set as to be $t_1° < t_2°$. In this manner, the thermostat assembly has two thermostats of the different operating characteristics, and both the thermostats are integrally connected in series through the frame 11.

In the thermostat assembly according to the present invention with this construction, a closed circuit is formed between both the terminals 13 and 13' through both the contact arms 14, 15 and the frame 11 under the normal state illustrated in the figures.

When, under the closed circuit state, the ambient temperature of the bimetals rises up to the predetermined temperature $t_1°$, the bimetal 17 operates reversely. A top part of the reversed bimetal 17 abuts against the protrusion 14'' of the contact arm 14 and pushes the arm 14 upwards. Thus, the contact 14' separates from the terminal fixture 13', and the thermostat falls into the open circuit state.

In such case where the contact 14' fuses and bonds to the terminal fixture 13' during the operation of the arm 14 or where the bimetal 17 suffers fatigue to render the reverse operation impossible, the contact arm 14 does not execute the "on"-"off" operation and its contact 14'' remains closed. Under such situation, the ambient temperature of the thermostat assembly rises more. When the temperature rises up to the value $t_2°$, the bimetal 18 operates reversely this time and pushes the contact arm 15 downwards. Thus, the contact 15' of the arm 15 separates away from the terminal fixture 13, and the thermostat falls into the open circuit state. That is, the thermostat assembly according to this embodiment effects two stages of protective operations.

Figure 6:
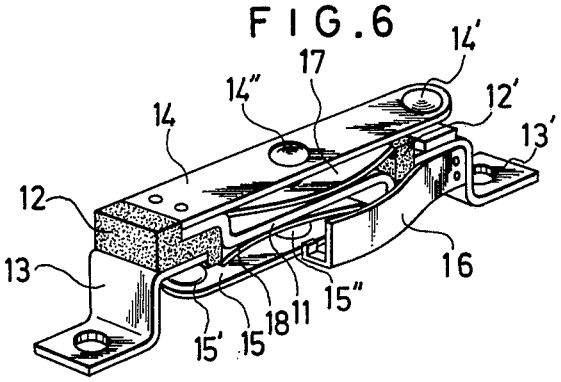
FIG. 6 is a perspective view showing another embodiment of the thermostat assembly illustrated in FIGS. 4 and 5.

FIG. 6 shows a state in which the thermostat assembly according to this embodiment is provided with a reset arm 16 similar to the reset arm 6 shown in FIG. 3. Quite like reset arm 6, reset arm 16 has the function of holding the open state of the contact arm 15.

The thermostat assembly according to this embodiment is structurally simple and compact and effects two stages of protective operations, so that a thermostat assembly which is high in safety and low in cost can be provided.

Now, a description will be given of a thermostat assembly according to the present invention which can operate in response to both the situations of an excessive temperature and an overcurrent.

As illustrated in FIGS. 7 and 8, the thermostat assembly comprises a contact arm 25 which has a construction and a function similar to those of the contact arm 5 shown in FIG. 2, and a contact arm 24 and a bimetal 27 which have constructions and functions similar to those of the contact arm 14 and the bimetal 17 of the thermostat assembly shown in FIG. 5. Of course, both the arms 24 and 25 are connected in series by a metallic frame 21, so that an electrical closed circuit is constructed between terminal fittings 23 and 23'.

The thermostat assembly of this embodiment operates as stated below. When the thermostat assembly is externally heated up to a certain predetermined temperature, the bimetal 27 operates reversely to push up a protrusion 24'' of the contact arm 24. Thus, the arm 24 ascends, the contact 24' separates away from the terminal fixture 23', and the thermostat falls into the open circuit state.

On the other hand, when, under the steady state illustrated in FIG. 8, an overcurrent exceeding a prescribed value passes through the contact arm 25 formed of the overcurrent sensing type bimetal, the arm 25 self-heats by the passing current and warps downwards, so that the contact 25' separates away from the terminal fixture 23. As the result, the thermostat falls into the open circuit state.

In this manner, the thermostat assembly operates to beome the open circuit state in either abnormal situation of the excessive temperature rise and the overcurrent.

FIG. 9 shows a state in which the thermostat assembly described above is provided with a reset arm 26. The reset arm 26 has quite the same function as that of the reset arm 6 or 16 shown in FIG. 3 or 6. While the reset arm 26 is disposed on the side of the contact arm 25 in the illustration of FIG. 9, it can of course be provided on the side of the contact arm 24. It is also possible to equip the respective contact arms 24 and 25 with such reset arms 26.

Since the thermostat assembly according to this embodiment can protect equipment or appliances in either situation of the excessive rise of the ambient temperature and the overcurrent, it has all the functions needed of a safety device. In addition, since it can be constructed compactly and in substantially the same geometry as that of a conventional thermostat, it is suitable as a sefety device for small-sized electronic equipment and appliances. Moreover, since it is simple in structure, it can be provided inexpensively.

What is claimed is:

1. A thermostat assembly comprising a stepped frame, two insulating members which are respectively secured to a lower surface of one end part of said frame and an upper surface of the other end part, terminal fixtures which are respectively secured to a lower surface of one of said insulating members and an upper surface of the other insulating member, and two contact arms which are respectively disposed on an upper surface and a lower surface of said frame in a manner to confront each other and to extend in directions opposite to each other, said contact arm arranged on said upper surface of said frame having its base part secured to the upper surface of said one end part of said frame and having its contact held in contact with an upper surface of one of said terminal fixtures, said contact arm arranged on said lower surface of said frame having its base part secured to the lower surface of said other end part of said frame and having its contact held in contact with a lower surface of the other terminal fixture.

2. The thermostat assembly according to claim 1, wherein said each contact arm is formed of a bimetal.

3. The thermostat assembly according to claim 1, wherein a bimetal is interposed between said contact arm and said frame.

4. A thermostat assembly comprising in combination:

a. a stepped elongated frame with a first and a second end part and an upper and lower surface;

b. upper and lower insulating members respectively secured to said first and second end part and disposed along said upper lower surfaces;

c. first and second terminal fixtures respectively secured to the respective upper and lower faces of said insulating members;

d. make and break first and second contact arms with base parts and contacts respectively disposed along said upper and lower surfaces and respectively secured at said base parts to said first and second ends so as to confront each other and to extend in directions opposite each other, said first and second contacts being respectively in contact with said first and second terminal fixtures and in electrical series connection;

e. bimetal means coupled to said first and second contact arms so contructed that said first contact arm will break contact before said second contact arm; and, f. a reset arm coupled to one of said end parts having cam means to slide over at least one of said contact arms.

* * * * *

UNITED STATES PATENT OFFICE

CERTIFICATE OF CORRECTION

Patent No. 4,092,624 Dated May 30, 1978

Inventor(s) Uchiya Tomoyoshi

It is certified that error appears in the above-identified patent and that said Letters Patent are hereby corrected as shown below:

On the cover page, Item [75] should read --- Tomoyoshi Uchiya ---.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*